US011814783B2

(12) United States Patent
Kawamura

(10) Patent No.: US 11,814,783 B2
(45) Date of Patent: Nov. 14, 2023

(54) SYNTHETIC LEATHER

(71) Applicant: SEIREN CO., LTD., Fukui (JP)

(72) Inventor: Kazunori Kawamura, Fukui (JP)

(73) Assignee: SEIREN CO., LTD., Fukui (JP)

( * ) Notice: Subject to any disclaimer, the term of this patent is extended or adjusted under 35 U.S.C. 154(b) by 189 days.

(21) Appl. No.: 17/173,404

(22) Filed: Feb. 11, 2021

(65) Prior Publication Data

US 2021/0254277 A1 Aug. 19, 2021

(30) Foreign Application Priority Data

Feb. 18, 2020 (JP) ..... 2020-025095

(51) Int. Cl.

| | |
|---|---|
| ***D06N 3/00*** | (2006.01) |
| ***D06N 3/14*** | (2006.01) |
| ***D04B 21/02*** | (2006.01) |
| ***D04B 21/06*** | (2006.01) |

(52) U.S. Cl.

CPC ..... *D06N 3/0009* (2013.01); *D04B 21/02* (2013.01); *D04B 21/06* (2013.01); *D06N 3/004* (2013.01); *D06N 3/0036* (2013.01); *D06N 3/14* (2013.01); *D06N 2211/28* (2013.01)

(58) Field of Classification Search

CPC .. D06N 3/0009; D06N 3/004; D06N 2211/28; D04B 21/06

See application file for complete search history.

(56) References Cited

U.S. PATENT DOCUMENTS

| | | | | |
|---|---|---|---|---|
| 2002/0114919 | A1* | 8/2002 | Yoneda | D06N 3/125 428/151 |
| 2005/0112975 | A1* | 5/2005 | McMurray | D04B 21/18 442/306 |
| 2010/0093243 | A1 | 4/2010 | Uemura et al. | |
| 2017/0342658 | A1* | 11/2017 | Kawamura | D06M 15/564 |

FOREIGN PATENT DOCUMENTS

| | | | | |
|---|---|---|---|---|
| JP | 2010-111989 | A | 5/2010 | |
| JP | 2011-069031 | A | 4/2011 | |
| KR | 20180130634 | A * | 12/2018 | |
| WO | WO-2015022772 | A1 * | 2/2015 | B32B 27/12 |
| WO | 2016/098324 | A1 | 6/2016 | |

OTHER PUBLICATIONS

"KR20180130634_Machine Translation" is a machine translation of KR-20180130634-A. (Year: 2018).*

"WO2015022772_Machine translation" is a machine translation of WO-2015022772-A1. (Year: 2015).*

Japanese Office Action issued in Japanese Patent Application No. 2020-025095 dated Sep. 19, 2023.

* cited by examiner

*Primary Examiner* — Larissa Rowe Emrich

(74) *Attorney, Agent, or Firm* — PEARNE & GORDON LLP

(57) ABSTRACT

Provided is a synthetic leather in which the occurrence of ease wrinkles can be inhibited or reduced. This synthetic leather comprises a cloth (10), and a resin layer (20) laminated on the cloth (10). The cloth (10) is a tricot knitted fabric knitted with front yarn, middle yarn, and back yarn, and having a nap (12). The tricot knitted fabric has a cord stitch structure knitted with the front yarn, a denbigh stitch structure or cord stitch structure knitted with the middle yarn, and an inlay structure or cord stitch structure knitted with the back yarn. The nap (12) is formed by napping a sinker loop side of the tricot knitted fabric.

13 Claims, 6 Drawing Sheets

SYNTHETIC LEATHER

BACKGROUND

The present invention relates to synthetic leathers in which a resin layer is laminated on a cloth.

Synthetic leather used as automotive interior materials and interior decoration materials such as chair upholstery is required to have workability and dimensional stability. To this end, as a cloth serving as a substrate for such synthetic leather, nonwoven fabric and woven fabric, which have excellent workability and dimensional stability, are suitably used. However, while they have excellent dimensional stability, nonwoven fabric and woven fabric are less stretchable. Therefore, in the case where nonwoven fabric and woven fabric are applied as, for example, a covering to a product having a complicated three-dimensional shape, the covering does not conform very closely to the shape, disadvantageously resulting in a poor appearance. Under these circumstances, attention has been paid to a synthetic leather in which knitted fabric is used as a substrate in order to improve shape conformability.

For example, known is a synthetic leather in which a polyurethane resin layer is laminated on a surface of tricot knitted fabric (see Japanese Unexamined Patent Application Publication No. 2010-111989). Japanese Unexamined Patent Application Publication No. 2010-111989 discloses a synthetic leather in which tricot knitted fabric is used as a substrate, and indicates that the synthetic leather has an improved constant-load elongation rate, good conformability to a product shape, and a good covering appearance.

In automotive interior applications, when synthetic leather is sewn into a complicated three-dimensional shape, "ease sewing" is carried out, in which two pieces of synthetic leather having different lengths are sewn together with one of the two pieces contracted. In ease sewing, as the reduction ratio (hereinafter referred to as an "ease ratio") by which the original size of synthetic leather to be eased is reduced to a size after easing increases, the finished three-dimensional shape is more round, and the contracted piece of synthetic leather is more likely to distort and wrinkle, i.e., a phenomenon called "ease wrinkles." Therefore, a synthetic leather for automotive interior applications is required to have properties that the synthetic leather can be sewn into a three-dimensional shape by ease sewing having a great ease ratio, and at the same time, is less likely to have ease wrinkles.

However, ease wrinkles are caused by distortion accompanying contraction, and therefore, it is difficult to inhibit or reduce the occurrence of ease wrinkles only by improving the elongation rate. The synthetic leather disclosed in Japanese Unexamined Patent Application Publication No. 2010-111989 is aimed at achieving high shape conformability by improving the elongation rate, and ease wrinkles are not therein taken into account.

SUMMARY

With the above problem in mind, the present invention has been made. It is an object of the present invention to provide a synthetic leather in which the occurrence of ease wrinkles is inhibited or reduced.

A synthetic leather according to an aspect of the present invention comprises a cloth, and a resin layer laminated on the cloth. The cloth is a tricot knitted fabric knitted with front yarn, middle yarn, and back yarn, and having a nap. The tricot knitted fabric has a cord stitch structure knitted with the front yarn, a denbigh stitch structure or cord stitch structure knitted with the middle yarn, and an inlay structure or cord stitch structure knitted with the back yarn. The nap is formed by napping a sinker loop side of the tricot knitted fabric.

In the synthetic leather thus configured, the cloth is a tricot knitted fabric knitted with front yarn, middle yarn, and back yarn, and having a nap. The tricot knitted fabric has a cord stitch structure knitted with the front yarn, a denbigh stitch structure or cord stitch structure knitted with the middle yarn, and an inlay structure or cord stitch structure knitted with the back yarn. The nap is formed by napping a sinker loop side of the tricot knitted fabric. Therefore, the cloth has an appropriate thickness. As a result, distortion occurring when the synthetic leather is contracted due to ease sewing can be accommodated by the cloth being compressed and deformed in the thickness direction, so that the occurrence of ease wrinkles can be inhibited or reduced.

In the synthetic leather of the present invention, the cloth preferably has a thickness of 0.9-3.0 mm.

In the synthetic leather thus configured, the cloth has the above appropriate thickness. Therefore, distortion accompanying ease sewing is accommodated by the cloth, so that the occurrence of ease wrinkles can be inhibited or reduced. In addition, in the synthetic leather thus configured, the synthetic leather advantageously has soft texture.

In the synthetic leather of the present invention, the cord stitch structure knitted with the front yarn preferably has an underlap of not less than three needle spaces.

In the synthetic leather thus configured, the cord stitch structure knitted with the front yarn has an underlap of not less than three needle spaces, and therefore, a longer nap is obtained by napping the front yarn. As a result, the cloth has an appropriate thickness to accommodate distortion accompanying ease sewing.

In the synthetic leather of the present invention, the inlay structure knitted with the back yarn preferably has an underlap of not less than three needle spaces.

In the synthetic leather thus configured, the inlay structure knitted with the back yarn has an underlap of not less than three needle spaces, and therefore, the cloth does not have a loop formed by the back yarn, and therefore, has a light weight. In addition, the overlaying of the sinker loop of the back yarn increases the thickness of the base knitted fabric, and therefore, the cloth has an appropriate thickness to accommodate distortion accompanying ease sewing.

In the synthetic leather of the present invention, the denbigh stitch structure knitted with the middle yarn preferably has a closed loop.

In the synthetic leather thus configured, the denbigh stitch structure knitted with the middle yarn has a closed loop. The denbigh stitch structure allows the cloth to have a light weight. Because of the closed loop, the cloth is less likely to undergo edge curling, resulting in good workability of the cloth during production of the synthetic leather.

In the synthetic leather of the present invention, the nap of the tricot knitted fabric preferably includes 65,000-850,000 filaments per 25.4 mm×25.4 mm, and preferably has 200,000-600,000 dtex (total deci-tex) per 25.4 mm×25.4 mm.

As used herein, the term "total deci-tex" refers to the total of the deci-tex values of all filaments of the nap per unit area. In the synthetic leather thus configured, the tricot knitted fabric has a nap having the above appropriate number of filaments and the above appropriate total deci-tex, and therefore, the nap is less likely to be crushed in the thickness direction when the resin layer is laminated on the nap. As a result, the cloth has an appropriate thickness to accommodate distortion accompanying ease sewing.

In the synthetic leather of the present invention, the front yarn preferably has a fineness of 44-250 dtex.

In the synthetic leather thus configured, the fineness of the front yarn is in the above appropriate range, and therefore, the nap is less likely to be crushed in the thickness direction when the resin layer is laminated on the nap. As a result, the cloth has an appropriate thickness to accommodate distortion accompanying ease sewing.

In the synthetic leather of the present invention, the middle and back yarns each preferably have a fineness of 30-220 dtex.

In the synthetic leather thus configured, the finenesses of the middle and back yarns are each in the above appropriate range, and therefore, the tricot knitted fabric has a thicker base knitted fabric. As a result, the cloth has an appropriate thickness to accommodate distortion accompanying ease sewing.

In the synthetic leather of the present invention, the front yarn preferably has a single yarn fineness of 0.3-5.5 dtex.

In the synthetic leather thus configured, the single yarn fineness of the front yarn is in the above appropriate range, and therefore, the adhesion to the resin layer is good. In addition, the nap is less likely to be crushed in the thickness direction when the resin layer is laminated on the nap, and therefore, the cloth has a more appropriate thickness.

In the synthetic leather of the present invention, the middle and back yarns each preferably have a single yarn fineness of 0.3-5.5 dtex.

In the synthetic leather thus configured, the single yarn finenesses of the middle and back yarns are each in the above appropriate range, and therefore, the tricot knitted fabric has a thicker base knitted fabric. As a result, the cloth has a more appropriate thickness.

In the synthetic leather of the present invention, the sum of a 5% circular modulus in a course direction of the tricot knitted fabric and a 5% circular modulus in a wale direction of the tricot knitted fabric is preferably 23-45 N/25.4 mm.

In the synthetic leather thus configured, the sum of the 5% circular modulus in the course direction of the tricot knitted fabric and the 5% circular modulus in the wale direction of the tricot knitted fabric is the above appropriate range, and therefore, the synthetic leather has appropriate flexibility. As a result, the occurrence of ease wrinkles can be further inhibited or reduced.

In the synthetic leather of the present invention, the 5% circular modulus in the course direction of the tricot knitted fabric is preferably 9-30 N/25.4 mm, and the 5% circular modulus in the wale direction of the tricot knitted fabric is preferably 10-22 N/25.4 mm.

In the synthetic leather thus configured, the 5% circular moduli in the course and wale directions of the tricot knitted fabric are in the above respective appropriate ranges, and therefore, the occurrence of ease wrinkles is further inhibited or reduced.

In the synthetic leather of the present invention, the resin layer is preferably laminated on a sinker loop side of the tricot knitted fabric, and the resin layer preferably has a thickness of 100-280 μm.

In the synthetic leather thus configured, the resin layer is laminated on the sinker loop side of the tricot knitted fabric, and therefore, the nap is in contact with the resin layer. As a result, the distortion of the resin layer accompanying ease sewing is accommodated by the nap being compressed and deformed in the thickness direction, and therefore, the occurrence of ease wrinkles can be inhibited or reduced. In addition, the resin layer has a thickness of 100-280 μm, and therefore, the occurrence of the distortion of the resin layer itself due to ease sewing can be inhibited or reduced.

DETAILED DESCRIPTION

A synthetic leather according to the present invention will now be described. Note that the present invention is in no way intended to be limited to configurations described below.

[Synthetic Leather]

Figure 1:
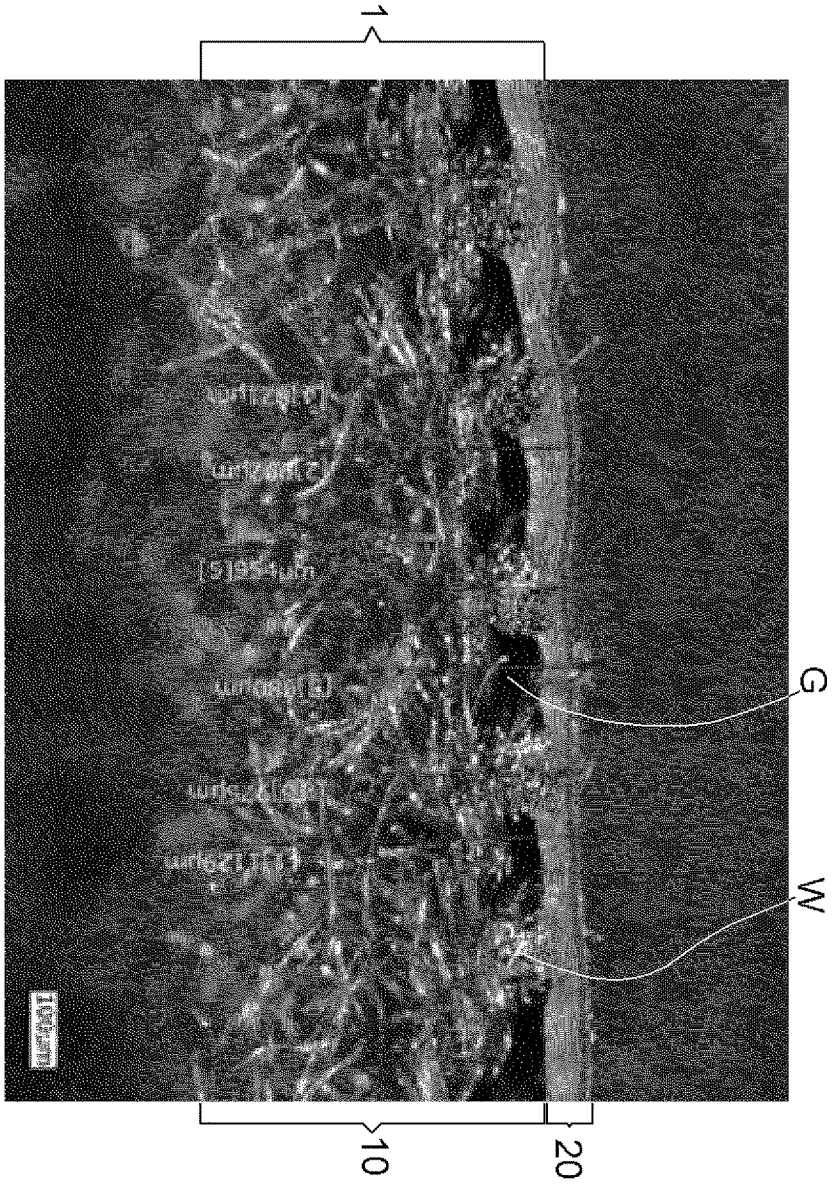
FIG. 1 is a cross-sectional image of a synthetic leather according to the present invention.

FIG. 1 shows a cross-sectional image of a synthetic leather 1 according to the present invention. The synthetic leather 1 has a cloth 10 and a resin layer 20 which is laminated on the cloth 10. As described above in the BACKGROUND section, when the synthetic leather 1 is sewn into a complicated three-dimensional shape by ease sewing, ease wrinkles are more likely to occur as the ease ratio increases. The present inventors have conceived of devising a knitted structure (a combination of knitted structures) of the cloth 10, which is a base cloth of the synthetic leather 1, and thereby imparting, to the synthetic leather 1, characteristics that inhibit or reduce the occurrence of ease wrinkles. Based on the conception, the present inventors have extensively studied to find that by the use of a tricot knitted fabric having a specific structure in the cloth 10, distortion occurring when the synthetic leather 1 is contracted due to ease sewing is accommodated by the cloth 10 being compressed and deformed in the thickness direction, so that the occurrence of ease wrinkles is inhibited or reduced.

<Cloth>

Figure 2:
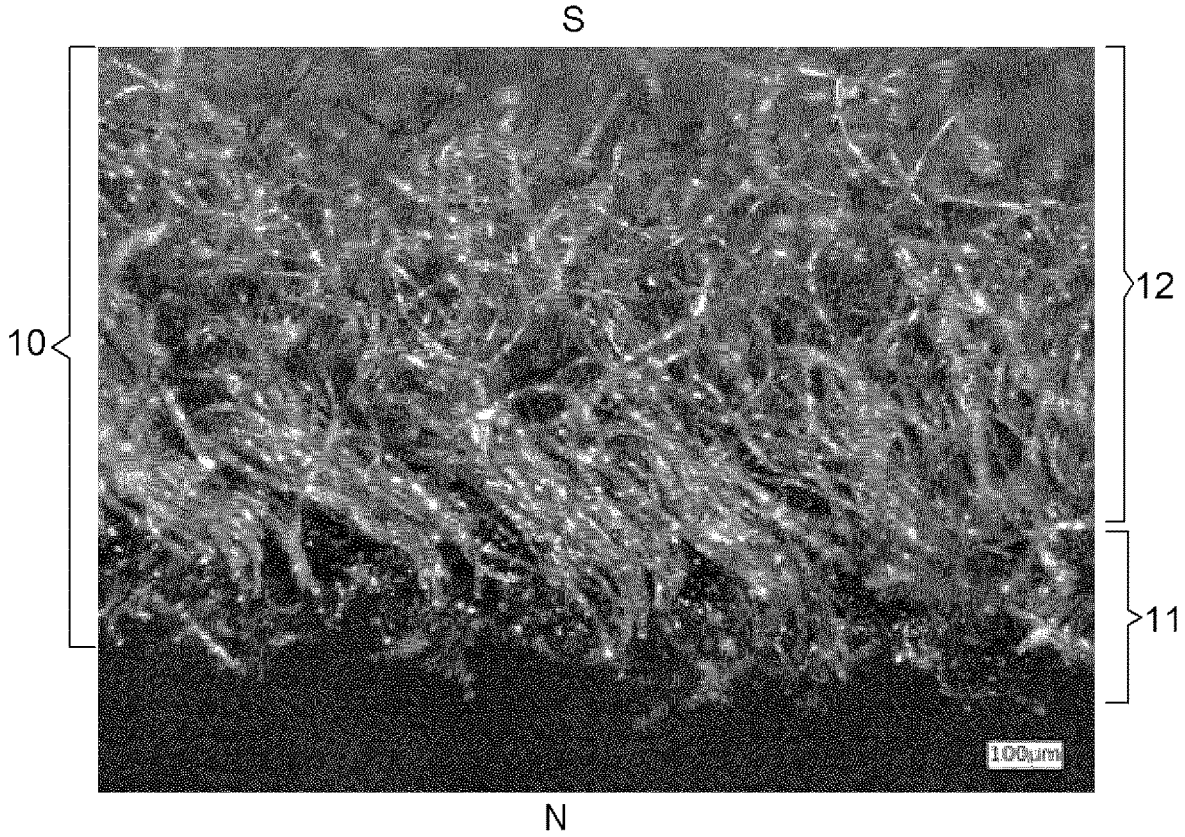
FIG. 2 is a cross-sectional image of a cloth used in a synthetic leather according to the present invention.
Figure 3:
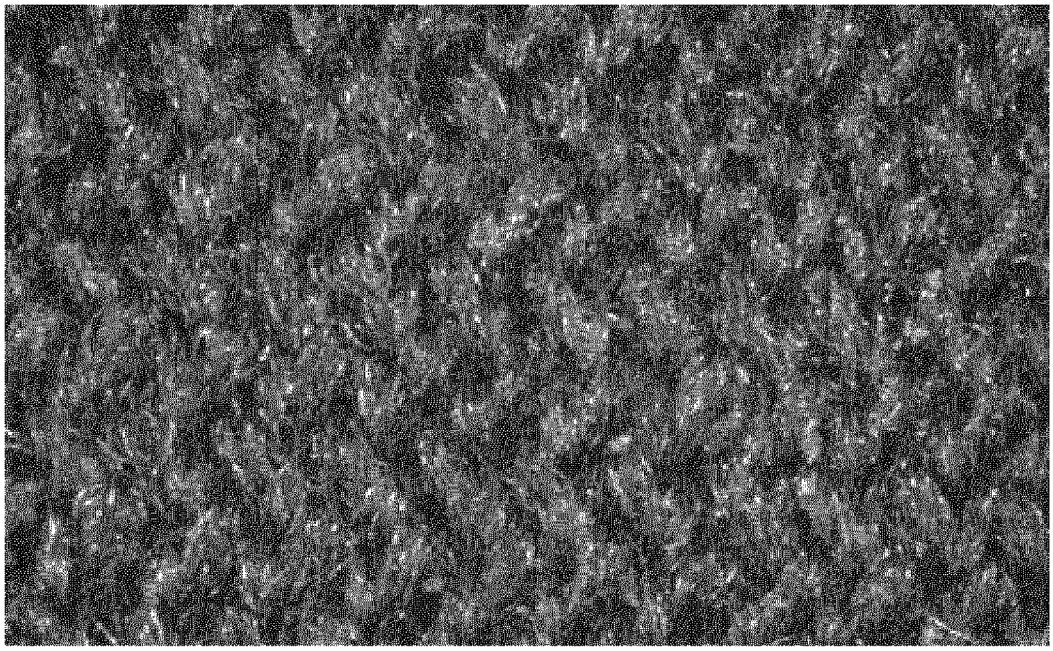
FIG. 3 is an image of a needle loop side of a cloth used in a synthetic leather according to the present invention.

FIG. 2 shows a cross-sectional image of the cloth 10 used in the synthetic leather 1 of the present invention. FIG. 3 shows an image of a needle loop side of the cloth 10. The cloth 10 is a tricot knitted fabric knitted with front yarn, middle yarn, and back yarn. The cloth 10 has a base knitted fabric 11 and a nap 12. The tricot knitted fabric used as the cloth 10 can be knitted using a warp knitting machine having at least one front guide bar, at least one middle guide bar, and at least one back guide bar, which are a guide bar. Here, the front, middle, and back guide bars are a plurality of guide bars that are arranged in a warp knitting machine in series from the sinker loop side S to the needle loop side N of a knitted fabric to be knitted. Yarns that are fed from the front, middle, and back guide bars to form a tricot knitted fabric are referred to as front yarn, middle yarn, and back yarn, respectively.

The cloth 10 preferably has a thickness of 0.9-3.0 mm, more preferably 1.0-1.8 mm. If the thickness of the cloth 10 is 0.9-3.0 mm, the cloth 10 can accommodate, in the thickness direction, distortion occurring when the synthetic leather 1 is contracted due to ease sewing, and can thereby inhibit or reduce the occurrence of ease wrinkles, and advantageously soften the texture of the synthetic leather 1. If the thickness of the cloth 10 is less than 0.9 mm, the occurrence of ease wrinkles is unlikely to be sufficiently inhibited or reduced. If the thickness of the cloth 10 is more than 3.0 mm, the texture of the synthetic leather 1 is likely to be impaired.

The base knitted fabric 11 is formed by a knitted structure knitted with the back yarn and a knitted structure knitted with the middle yarn.

The knitted structure knitted with the back yarn is an inlay structure or cord stitch structure, particularly preferably an inlay structure. In the case where the knitted structure knitted with the back yarn is the abovementioned knitted structure, when the sinker loop of the knitted structure knitted with the back yarn and the knitted structure knitted with the middle yarn are put on top of each other, as shown in the image of FIG. 3 high ridges are formed on the base knitted fabric 11, and therefore, the cloth 10 has an appropriate thickness to accommodate distortion accompanying ease sewing. In this case, the back yarn is preferably knitted to form an underlap of three or more needle spaces. If the underlap formed by the back yarn has three or more needle spaces, three or more sinker loops formed by the back yarn are put on top of one needle loop, so that the thickness of the base knitted fabric 11 can be further increased. If the knitted structure knitted with the back yarn is an inlay structure, no loop is formed by the back yarn, and therefore, the weight of the cloth 10 is reduced.

The knitted structure knitted with the middle yarn is a denbigh stitch structure or cord stitch structure. In the case where the knitted structure knitted with the middle yarn is the abovementioned knitted structure, the edge curling of the cloth 10 is less likely to occur, leading to better workability during production of the synthetic leather 1. In particular, in the case where the knitted structure knitted with the back yarn is an inlay structure, the knitted structure knitted with the middle yarn is preferably a denbigh stitch structure. If the knitted structure knitted with the middle yarn is a denbigh stitch structure, an inlay structure can be knitted by appropriately inserting the back yarn, and at the same time, the middle yarn itself forms an underlap of one needle space, resulting in a light-weight cloth 10. In this case, the denbigh stitch structure is preferably knitted with a closed loop. If the denbigh stitch structure is knitted with a closed loop, the stretching of the cloth 10 is inhibited or reduced in the wale direction of the tricot knitted fabric, which reduces the occurrence of edge curling.

The nap 12 is obtained by subjecting the sinker loop side S of the cloth 10 to a napping treatment so that the knitted structure knitted with the front yarn or middle yarn is napped. The knitted structure knitted with the front yarn is a cord stitch structure, particularly preferably a cord stitch structure that has an underlap of three or more needle spaces. In the case where the nap 12 is formed by napping the front yarn, then if the knitted structure knitted with the front yarn is a cord stitch structure, a longer nap 12 is obtained, and therefore, the cloth 10 has an appropriate thickness. If the knitted structure knitted with the front yarn has an underlap of three or more needle spaces, an even longer nap 12 is obtained by the front yarn. The napping treatment performed on the sinker loop side S is a semi-cut napping treatment or full-cut napping treatment, particularly preferably a semi-cut napping treatment. In the case where a full-cut napping treatment is performed, the napping treatment needs to be performed to such a small extent that the middle and back yarns are not napped, so as not to reduce the strength of the cloth 10.

The nap 12 of the cloth 10 preferably includes 65,000-850,000 filaments per 25.4 mm×25.4 mm and has 200,000-600,000 dtex (total deci-tex) per 25.4 mm×25.4 mm, more preferably 80,000-450,000 filaments per 25.4 mm×25.4 mm and 270,000-480,000 dtex (total deci-tex) per 25.4 mm×25.4 mm. In the case where the nap 12 includes 65,000-850,000 filaments per 25.4 mm×25.4 mm and has 200,000-600,000 dtex per 25.4 mm×25.4 mm, the nap 12 is less likely to be crushed in the thickness direction when the resin layer 20 is laminated on the nap 12, and therefore, the cloth 10 has an appropriate thickness to accommodate distortion accompanying ease sewing. If the number of filaments or the total deci-tex of the nap 12 is less than the respective lower limit value, the nap 12 is likely to be crushed when the resin layer 20 is laminated on the nap 12, resulting in a decrease in the thickness of the cloth 10. If the number of filaments or the total deci-tex of the nap 12 is more than the respective upper limit value, the free mobility of filaments of the nap 12 decreases, and therefore, the cloth is unlikely to sufficiently accommodate distortion accompanying ease sewing. For example, in the case where the napping treatment is a full-cut napping treatment, a single front guide bar is used, and the front guide bar has an a-in/b-out yarn dropping pattern, the number T of filaments of the nap 12 per 25.4 mm×25.4 mm can be calculated by:

$$T=f\times d_1\times d_2\times 2\times\{a/(a+b)\} \quad (1)$$

where f represents the number of filaments of the front yarn, $d_1$ (courses/25.4 mm) represents the course density of the tricot knitted fabric, and $d_2$ (wales/25.4 mm) represents the wale density of the tricot knitted fabric. Note that in the case where the front guide bar includes a plurality of guide bars, T is calculated by expression (1) for each front guide bar, and is added up, whereby the number of filaments of the nap 12 per 25.4 mm×25.4 mm can be calculated. The total deci-tex is the sum of the deci-tex values of all filaments of the nap 12 in a unit area. The total deci-tex Dt of the filaments of the nap 12 per 25.4 mm×25.4 mm can be calculated by:

$$Dt=(Df\times d_1\times d_2\times R)/100 \quad (2)$$

where Df (dtex) represents the fineness of filaments of the nap 12 (e.g., the front yarn), $d_1$ (courses/25.4 mm) represents the course density of the tricot knitted fabric, $d_2$ (wales/25.4 mm) represents the wale density of the tricot knitted fabric, and R (%) represents the nap rate, where the nap rate is defined as the ratio of portion of a multifilament yarn cut by napping process (raising process).

The forms of the front, middle, and back yarns are not particularly limited, and may each be either filament yarn or spun yarn. In the case where filament yarn is used, the yarn may be optionally twisted, or may be treated by a false-twisting process, a fluid disturbance process (taslan process, interlacing, or the like), or the like, to be crimped or bulked. In particular, the middle and back yarns are each preferably bulked in order to increase the thickness of the base knitted fabric 11 and thereby impart an appropriate thickness to the cloth 10.

If the finenesses of the front, middle, and back yarns have an appropriate relationship, the cloth 10 can have an appropriate thickness and knitting performance. For example, a fineness ratio Dr that is calculated as follows is preferably 0.5-2.5:

$$Dr=Df/(Dm+Db) \quad (3)$$

where Df (dtex) represents the fineness of the front yarn, Dm (dtex) represents the fineness of the middle yarn, and Db (dtex) represents the fineness of the back yarn.

If the fineness ratio Dr is not less than 0.5, the cloth 10 has an appropriate thickness. If the fineness ratio Dr is not more than 2.5, the cloth 10 has good knitting performance.

The fineness of the front yarn is preferably 44-250 dtex, more preferably 110-168 dtex. If the fineness of the front yarn is 44-250 dtex, the nap 12 is less likely to be crushed in the thickness direction when the resin layer 20 is laminated on the nap 12, and therefore, the cloth 10 can have an appropriate thickness to accommodate distortion accompanying ease sewing. If the fineness of the front yarn is less than 44 dtex, the nap 12 is likely to be crushed when the resin layer 20 is laminated on the nap 12, resulting in a decrease in the thickness of the cloth 10. If the fineness of the front yarn is more than 250 dtex, the free mobility of filaments of the nap 12 is reduced, so that the cloth 10 is unlikely to sufficiently accommodate distortion accompanying ease sewing.

The finenesses of the middle and back yarns are each preferably 30-220 dtex, more preferably 56-110 dtex. If the finenesses of the middle and back yarns are each 30-220 dtex, a thick base knitted fabric 11 is obtained, and therefore, the cloth 10 has an appropriate thickness to accommodate distortion accompanying ease sewing, and the synthetic leather 1 has an appropriate strength. If the finenesses of the middle and back yarns are each less than 30 dtex, the thickness of the cloth 10 is reduced, and therefore, ease wrinkles are more likely to occur, and the synthetic leather 1 is likely to have a poor strength. If the finenesses of the middle and back yarns are each more than 220 dtex, the synthetic leather 1 is likely to be less stretchable, leading to an easier occurrence of ease wrinkles.

A material for fibers or filaments (monofilaments) forming the front, middle, and back yarns is not particularly limited, and may be, for example, natural fibers, regenerated fibers, semisynthetic fibers, synthetic fibers, or the like. Of them, synthetic fibers are preferable in terms of mechanical strength, heat resistance, and light resistance, more preferably polyester fibers. In addition, composite fibers including a combination of two or more materials may be used. In addition, fibers having a function may be used, such as conventionally known functional fibers having flame retardancy, electrical conductivity, deodorizing ability, or the like. For example, in the case where high flame retardancy is required, flame retardant fibers can be used. The shape of the fiber is not particularly limited, and may be either a long fiber of short fiber. The cross-sectional shape of the fiber is not particularly limited, and may be either a typical round shape or an atypical shape such as a flat shape, an elliptical shape, a triangular shape, a hollow shape, a Y shape, a T shape, or a U shape.

The single yarn fineness of the front yarn is preferably 0.3-5.5 dtex, more preferably 1.0-4.0 dtex. If the single yarn fineness of the front yarn is 0.3-5.5 dtex, the adhesion to the resin layer 20 is good. In addition, the nap 12 is less likely to be crushed in the thickness direction when the resin layer 20 is laminated on the nap 12, and therefore, the cloth has an appropriate thickness to accommodate distortion accompanying ease sewing. If the single yarn fineness of the front yarn is less than 0.3 dtex, the nap 12 is likely to be crushed when the resin layer 20 is laminated on the nap 12, resulting in a decrease in the thickness of the cloth 10. If the single yarn fineness of the front yarn is more than 5.5 dtex, the adhesion to the resin layer 20 is unlikely to be good.

The single yarn finenesses of the middle and back yarns are each preferably 0.3-5.5 dtex, more preferably 1.0-4.0 dtex. If the single yarn finenesses of the middle and back yarns are 0.3-5.5 dtex, the synthetic leather 1 has good durability and texture. In addition, the increase in thickness of the base knitted fabric 11 allows the cloth 10 to have an appropriate thickness to accommodate distortion accompanying ease sewing. If the single yarn finenesses of the middle and back yarns are less than 0.3 dtex, sufficient durability is unlikely to be obtained. If the single yarn finenesses of the middle and back yarns are more than 5.5 dtex, texture is likely to be hard.

<Resin Layer>

Figure 4:
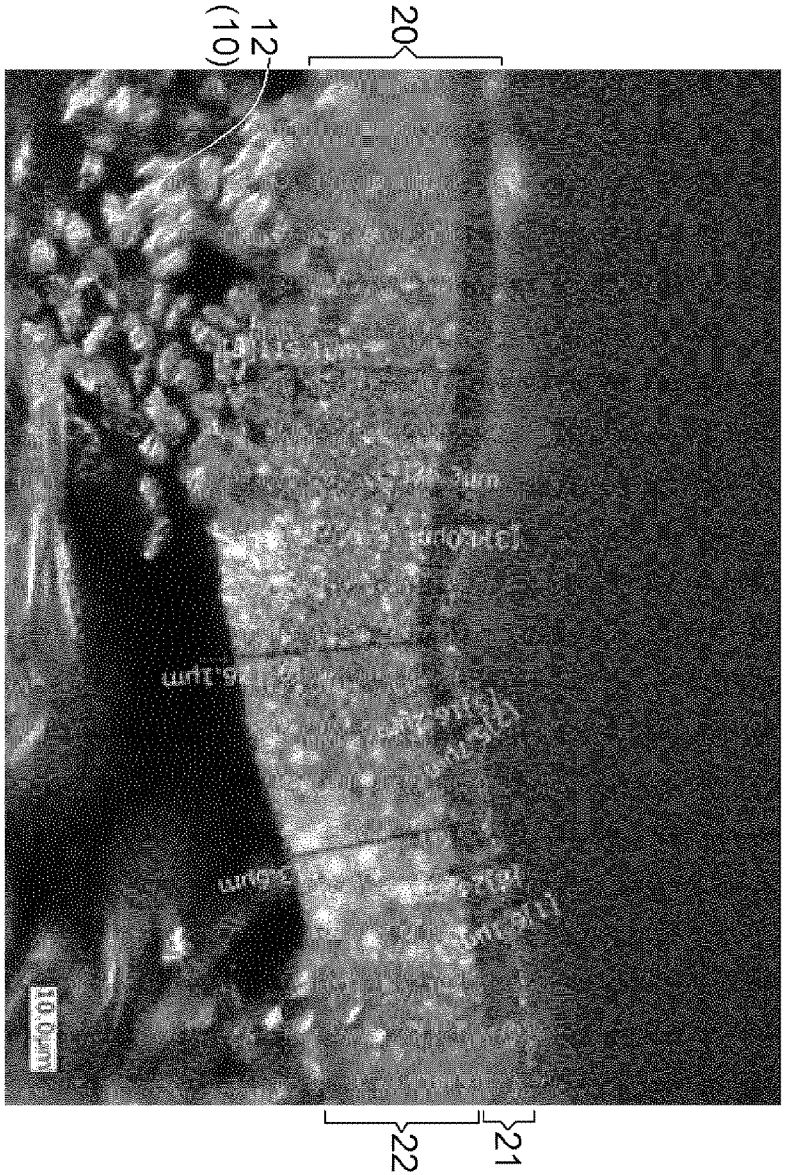
FIG. 4 is a cross-sectional image of a synthetic leather at and near a resin layer.

FIG. 4 shows a cross-sectional image of the synthetic leather 1 at and near the resin layer 20. The resin layer 20 can be similar to that which is used in conventional synthetic leather, and the resin type and layered structure thereof are not particularly limited. Examples of the resin included in the resin layer 20 include polyurethane resins and vinyl chloride resins. For example, in the cross-sectional image of FIG. 4, the resin layer 20 has a layered structure that has a skin layer 21 including a resin sheet, and an adhesive layer 22 with which the skin layer 21 adheres to the cloth 10. The resin layer 20 preferably has a thickness of 100-280 μm. Note that the synthetic leather 1 preferably has an overall thickness of 1000-3280 μm by the cloth 10 and the resin layer 20 having the above respective preferable thicknesses. If the thickness of the resin layer 20 is 100-280 μm, the resin layer is less distorted when the synthetic leather 1 is contracted due to ease sewing, and therefore, the distortion is more easily accommodated by the cloth 10. If the thickness of the resin layer 20 is less than 100 μm, the synthetic leather 1 is likely to have a poor strength. If the thickness of the resin layer 20 is more than 280 μm, the resin layer 20 is significantly distorted when the synthetic leather 1 is contracted due to ease sewing, and therefore, the cloth 10 is unlikely to sufficiently accommodate the distortion. The resin layer 20 is preferably laminated on the sinker loop side S of the cloth 10. On the sinker loop side S of the cloth 10, ridges W are formed on the nap 12 (see FIG. 1) due to an influence of the ridges formed on the base knitted fabric 11. Therefore, if the resin layer 20 is laminated on the sinker loop side S, the cloth 10 and the resin layer 20 adhere to each other at the ridges W, and a groove G is formed between each ridge W (see FIG. 1). In the groove G, the yarn forming the cloth 10 is easily moved freely, and therefore, even when relatively large distortion occurs due to ease sewing, the cloth 10 can accommodate the distortion.

[5% Circular Modulus]

The synthetic leather 1 of the present invention has the function of accommodating distortion accompanying ease sewing, through compressive deformation of the cloth 10 in the thickness direction. In addition, the synthetic leather 1 of the present invention has appropriate flexibility, whereby the occurrence of ease wrinkles is further inhibited or reduced. As an index of such flexibility, for the synthetic leather 1 of the present invention, the sum of a 5% circular modulus as measured in the course direction of the tricot knitted fabric and a 5% circular modulus as measured in the wale direction of the tricot knitted fabric is preferably 23-45 N/25.4 mm. If the sum of the 5% circular modulus as measured in the course direction and the 5% circular modulus as measured in the wale direction is in the above range, the synthetic leather 1 has appropriate flexibility, and therefore, ease wrinkles are more unlikely to occur. In the case where the sum of the 5% circular modulus as measured in the course direction and the 5% circular modulus as measured in the wale direction is in the above range, the 5% circular modulus as measured in the course direction is preferably 9-30 N/25.4 mm, and the 5% circular modulus as measured in the wale direction is preferably 10-22 N/25.4 mm. If the 5% circular modulus as measured in the course direction and the 5% circular modulus as measured in the wale direction are in the above respective ranges, ease wrinkles are even more unlikely to occur.

The 5% circular modulus was measured by the following procedure. Initially, two test specimens having a diameter of 300 mm were taken from the synthetic leather 1. The two test specimens were attached to the grab tool of a tensile tester autograph (AG-100A, manufactured by Shimadzu Corporation) without slack, where the grab width was 25.4 mm, in an atmosphere having a room temperature of 20±2° C. and a humidity of 65±5% RH. The two test specimens were oriented so as to be elongated in the course and wale directions, respectively. Each test specimen was pulled where the movement speed of the grab tool was 200 mm/min. The load (N/25.4 mm) of each test specimen was measured at 5% elongation thereof.

EXAMPLES

Synthetic leathers (Examples 1-6) according to the present invention were prepared, and the occurrence of ease wrinkles during ease sewing was assessed. For comparison, synthetic leathers (Comparative Examples 1-5) that did not fall within the ranges of the present invention were prepared and similarly assessed.

[Ease Wrinkles]

A test specimen having a width of 50 mm and a length of 100 mm was taken from each synthetic leather in each of the course and wale directions of the tricot knitted fabric. Each test specimen was subjected to ease sewing where the length thereof was contracted to 97 mm. After the ease sewing, the occurrence of ease wrinkles was visually checked and assessed according to the following criteria for each test specimen.

++: no ease wrinkles occurred

+: a few ease wrinkles occurred, which did not pose a practical problem

−: ease wrinkles occurred

Example 1

Figure 5A:
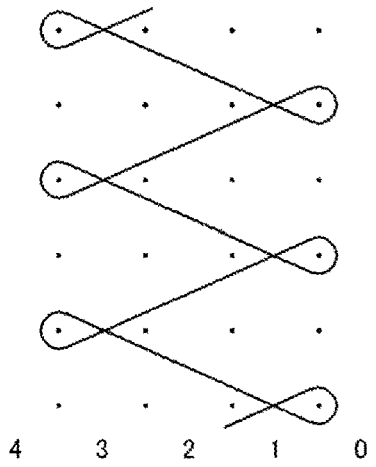
FIGS. 5A-5F are stitch diagrams of knitted structures of tricot knitted fabrics used in synthetic leathers of examples and comparative examples.

The front guide bar of a 3-guide bar tricot knitting machine (HKS3M, manufactured by Nippon Mayer Ltd.) was full-set threaded with PET2H textured yarn of 168 dtex/48 f as front yarn to form a cord stitch structure (three-needle underlap) shown in FIG. 5A. The middle guide bar was full-set threaded with PET crimpable yarn of 84 dtex/24 f as middle yarn to form a denbigh stitch structure having a closed loop shown in FIG. 5B. The back guide bar was full-set threaded with PET crimpable yarn of 84 dtex/36 f as back yarn to form an inlay structure (three-needle underlap) shown in FIG. 5C. Thus, a tricot knitted fabric was knitted. The sinker loop side of the tricot knitted fabric thus obtained was subjected to a semi-cut napping treatment to form a nap in which the front yarn was napped, followed by presetting at 190° C. for 1 minute, then dying at 130° C., then drying, and then finishing setting at 150° C. for 1 minute.

A polyurethane resin liquid was prepared by adding 40 parts by mass of dimethyl formamide to 100 parts by mass of a polycarbonate polyurethane resin (CRISVON NY-328, manufactured by DIC Corporation) and thereby adjusting the viscosity thereof to about 2000 mPa·s. The polyurethane resin liquid was applied to release paper to form a coating having a thickness of 200 μm, followed by drying at 130° C. for 2 minutes, to obtain a polyurethane resin sheet as a skin layer.

An adhesive resin solution was prepared by adding 50 parts by mass of dimethyl formamide to 100 parts by mass of a polycarbonate polyurethane adhesive (CRISVON TA-205, manufactured by DIC Corporation) and thereby adjusting the viscosity thereof to about 4500 mPa·s. The adhesive resin solution was applied to the above polyurethane resin sheet to a thickness of 200 μm, followed by drying at 100° C. for 1 minute, to form an adhesive layer. The adhesive layer thus obtained was bonded to the sinker loop side of the tricot knitted fabric by pressure bonding of 39.2 N/cm$^2$ for 1 minute to obtain a synthetic leather of Example 1. In the synthetic leather of Example 1, the cloth had a thickness of 1.35 mm, and the resin layer had a thickness of 260 μm, and therefore, the synthetic leather had an overall thickness of 1610 μm. The synthetic leather of Example 1 had a 5% circular modulus of 10.30 N/25.4 mm in the course direction, and 15.32 N/25.4 mm in the wale direction. The sum of the 5% circular moduli in the course and wale directions was 25.62 N/25.4 mm.

Example 2

A synthetic leather of Example 2 was prepared using a procedure and conditions similar to those of Example 1, except that the middle yarn was replaced by PET1H textured yarn of 84 dtex/36 f, and the back yarn was replaced by PET1H textured yarn of 84 dtex/36 f. In the synthetic leather of Example 2, the cloth had a thickness of 1.35 mm, and the resin layer had a thickness of 220 μm, and therefore, the synthetic leather had an overall thickness of 1570 μm. The synthetic leather of Example 2 had a 5% circular modulus of 19.29 N/25.4 mm in the course direction, and 20.55 N/25.4 mm in the wale direction. The sum of the 5% circular moduli in the course and wale directions was 39.84 N/25.4 mm.

Example 3

A synthetic leather of Example 3 was prepared using a procedure and conditions similar to those of Example 1, except that the front yarn was replaced by PET2H textured yarn of 110 dtex/36 f. In the synthetic leather of Example 3, the cloth had a thickness of 1.15 mm, and the resin layer had a thickness of 130 μm, and therefore, the synthetic leather had an overall thickness of 1280 μm. The synthetic leather of Example 3 had a 5% circular modulus of 22.29 N/25.4 mm in the course direction, and 19.32 N/25.4 mm in the wale direction. The sum of the 5% circular moduli in the course and wale directions was 41.61 N/25.4 mm.

Example 4

A synthetic leather of Example 4 was prepared using a procedure and conditions similar to those of Example 1, except that the middle yarn was replaced by PET2H textured yarn of 84 dtex/36 f, and the back yarn was replaced by PET2H textured yarn of 84 dtex/36 f. In the synthetic leather of Example 4, the cloth had a thickness of 1.24 mm, and the resin layer had a thickness of 190 μm, and therefore, the synthetic leather had an overall thickness of 1430 μm. The synthetic leather of Example 4 had a 5% circular modulus of 17.98 N/25.4 mm in the course direction, and 17.94 N/25.4 mm in the wale direction. The sum of the 5% circular moduli in the course and wale directions was 35.92 N/25.4 mm.

Example 5

Figure 6A:
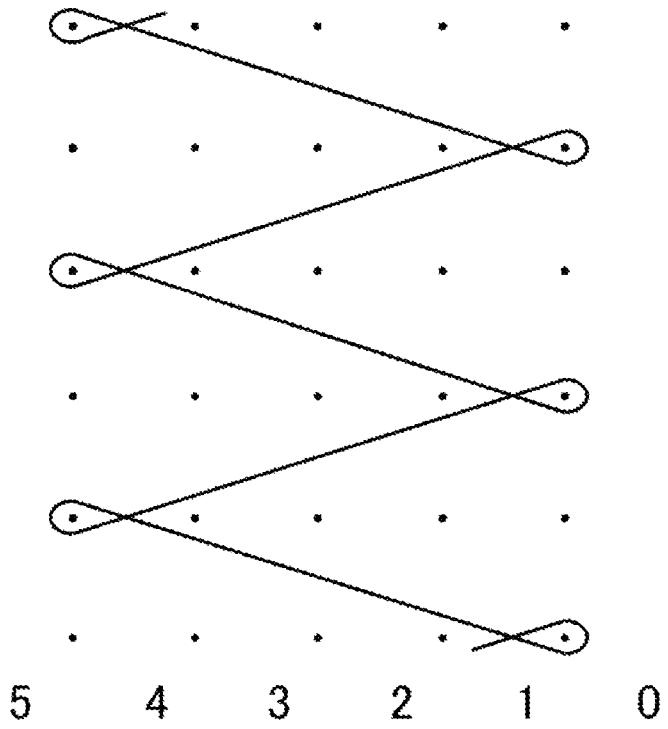
FIGS. 6A and 6B are stitch diagrams of knitted structures of tricot knitted fabrics used in synthetic leathers of examples.

A synthetic leather of Example 5 was prepared using a procedure and conditions similar to those of Example 1, except that the front yarn was replaced by PET2H textured yarn of 168 dtex/144 f, and the knitted structure knitted with the front yarn was replaced by a cord stitch structure (four-needle underlap) shown in FIG. 6A. In the synthetic leather of Example 5, the cloth had a thickness of 1.52 mm, and the resin layer had a thickness of 110 μm, and therefore, the synthetic leather had an overall thickness of 1630 μm. The synthetic leather of Example 5 had a 5% circular modulus of 28.32 N/25.4 mm in the course direction, and 13.54 N/25.4 mm in the wale direction. The sum of the 5% circular moduli in the course and wale directions was 41.86 N/25.4 mm.

Example 6

Figure 6B:
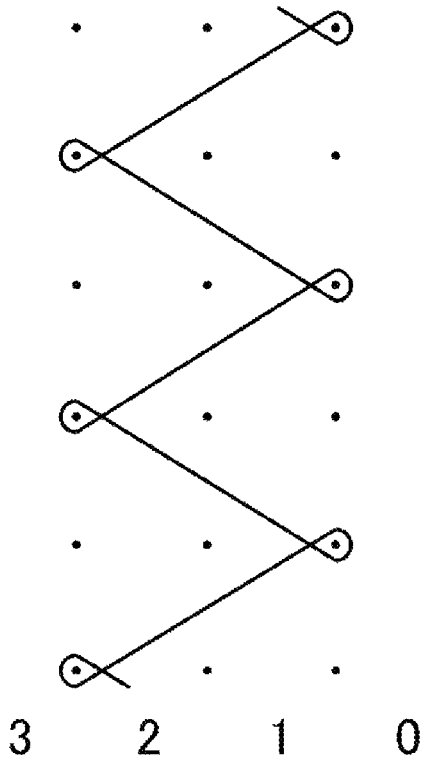

A synthetic leather of Example 6 was prepared using a procedure and conditions similar to those of Example 1, except that the front yarn was replaced by PET2H textured yarn of 168 dtex/144 f, the back yarn was replaced by PET crimpable yarn of 44 dtex/12 f, and the knitted structure knitted with the back yarn was replaced by a cord stitch structure (two-needle underlap) shown in FIG. 6B. In the synthetic leather of Example 6, the cloth had a thickness of 1.45 mm, and the resin layer had a thickness of 200 μm, and therefore, the synthetic leather had an overall thickness of 1650 μm. The synthetic leather of Example 6 had a 5% circular modulus of 13.32 N/25.4 mm in the course direction, and 11.34 N/25.4 mm in the wale direction. The sum of the 5% circular moduli in the course and wale directions was 24.66 N/25.4 mm.

Comparative Example 1

A synthetic leather of Comparative Example 1 was prepared using a procedure and conditions similar to those of Example 2, except that the knitted tricot knitted fabric was not subjected to a napping treatment. In the synthetic leather of Comparative Example 1, the cloth had a thickness of 0.93 mm, and the resin layer had a thickness of 220 μm, and therefore, the synthetic leather had an overall thickness of 1150 μm. The synthetic leather of Comparative Example 1 had a 5% circular modulus of 26.32 N/25.4 mm in the course direction, and 19.32 N/25.4 mm in the wale direction. The sum of the 5% circular moduli in the course and wale directions was 45.64 N/25.4 mm.

Comparative Example 2

Figure 5B:
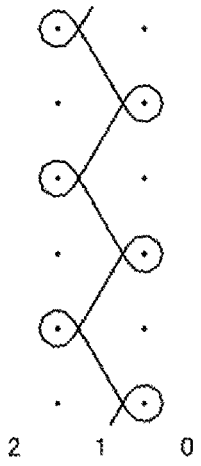
Figure 5C:
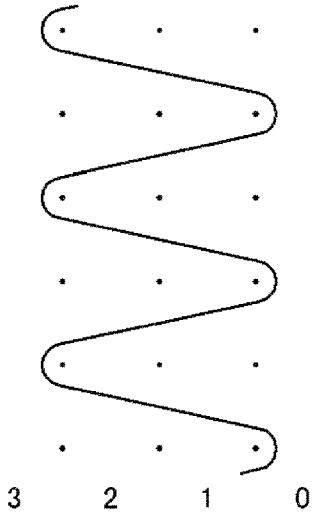
Figure 5D:
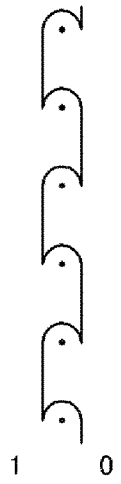

A synthetic leather of Comparative Example 2 was prepared using a procedure and conditions similar to those of Example 1, except that the knitted structure knitted with the middle yarn was replaced by a chain stitch structure shown in FIG. 5D, and the knitted tricot knitted fabric was not subjected to a napping treatment. In the synthetic leather of Comparative Example 2, the cloth had a thickness of 1.02 mm, and the resin layer had a thickness of 190 μm, and therefore, the synthetic leather had an overall thickness of 1210 μm. The synthetic leather of Comparative Example 2 had a 5% circular modulus of 28.34 N/25.4 mm in the course direction, and 20.30 N/25.4 mm in the wale direction. The sum of the 5% circular moduli in the course and wale directions was 48.64 N/25.4 mm.

Comparative Example 3

Figure 5E:
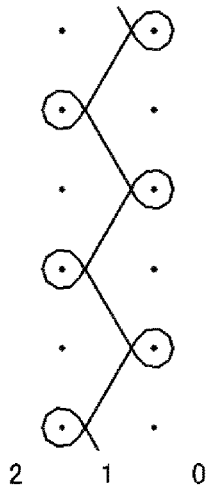

A synthetic leather of Comparative Example 3 was prepared using a procedure and conditions similar to those of Example 1, except that the knitted structure knitted with the back yarn was replaced by a denbigh stitch structure having a closed loop shown in FIG. 5E. In the synthetic leather of Comparative Example 3, the cloth had a thickness of 1.08 mm, and the resin layer had a thickness of 180 μm, and therefore, the synthetic leather had an overall thickness of 1260 μm. The synthetic leather of Comparative Example 3 had a 5% circular modulus of 36.43 N/25.4 mm in the course direction, and 16.12 N/25.4 mm in the wale direction. The sum of the 5% circular moduli in the course and wale directions was 52.55 N/25.4 mm.

Comparative Example 4

Figure 5F:
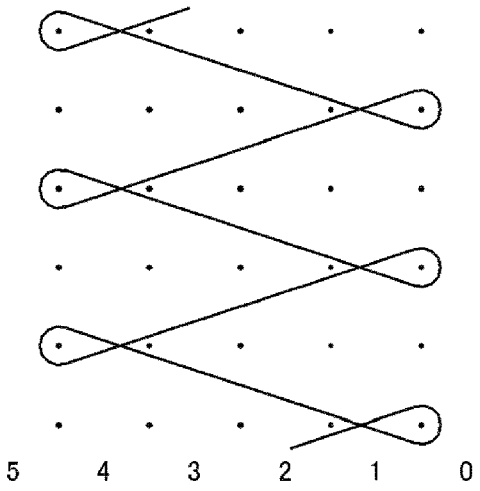

A synthetic leather of Comparative Example 4 was prepared using a procedure and conditions similar to those of Example 1, except that the front yarn was replaced by PET crimpable yarn of 84 dtex/24 f, the knitted structure knitted with the front yarn was replaced by the denbigh stitch structure having a closed loop shown of FIG. 5B, the middle yarn was replaced by PET crimpable yarn of 168 dtex/48 f, and the knitted structure knitted with the middle yarn was replaced by a cord stitch structure (four-needle underloop) shown in FIG. 5F, and the sinker loop side of the tricot knitted fabric was subjected to a semi-cut napping treatment to form a nap having napped middle yarn. In the synthetic leather of Comparative Example 4, the cloth had a thickness of 1.17 mm, and the resin layer had a thickness of 130 μm, and therefore, the synthetic leather had an overall thickness of 1300 μm. The synthetic leather of Comparative Example 4 had a 5% circular modulus of 32.73 N/25.4 mm in the course direction, and 17.21 N/25.4 mm in the wale direction. The sum of the 5% circular moduli in the course and wale directions was 49.94 N/25.4 mm.

Comparative Example 5

A synthetic leather of Comparative Example 5 was prepared using a procedure and conditions similar to those of Example 1, except that the knitted structure knitted with the front yarn was replaced by the denbigh stitch structure having a closed loop of FIG. 5B, and the knitted structure knitted with the middle yarn was replaced by the chain stitch structure of FIG. 5D. In the synthetic leather of Comparative Example 5, the cloth had a thickness of 0.89 mm, and the resin layer had a thickness of 180 μm, and therefore, the synthetic leather had an overall thickness of 1070 μm. The synthetic leather of Comparative Example 5 had a 5% circular modulus of 24.12 N/25.4 mm in the course direction, and 28.43 N/25.4 mm in the wale direction. The sum of the 5% circular moduli in the course and wale directions was 52.55 N/25.4 mm.

Details and assessment results of the synthetic leathers of Examples 1-6 are shown in Table 1 below. Details and assessment results of the synthetic leathers of Comparative Examples 1-5 are shown in Table 2 below.

TABLE 1

| | | | Example 1 | Example 2 | Example 3 | Example 4 | Example 5 | Example 6 |
|---|---|---|---|---|---|---|---|---|
| Yarn positions | Front yarn | Fineness | 168 dtex/48 f | 168 dtex/48 f | 110 dtex/36 f | 168 dtex/48 f | 168 dtex/144 f | 168 dtex/144 f |
| | | Single yarn fineness | 3.5 dtex | 3.5 dtex | 3.1 dtex | 3.5 dtex | 1.17 dtex | 1.17 dtex |
| | | Yarn type | PET 2 H textured yarn | PET 2 H textured yarn | PET 2H textured yarn | PET 2 H textured yarn | PET 2 M textured yarn | PET 2 H textured yarn |
| | Middle yarn | Fineness | 84 dtex/24 f | 84 dtex/36 f | 84 dtex/24 f | 84 dtex/36 f | 84 dtex/24 f | 84 dtex/24 f |
| | | Single yarn fineness | 3.5 dtex | 2.3 dtex | 3.5 dtex | 2.3 dtex | 3.5 dtex | 3.5 dtex |
| | | Yarn type | PET Crimpable yarn | PET 1 H textured yarn | PET Grimpable yarn | PET 2 H textured yarn | PET Crimpable yarn | PET Crimpable yarn |
| | Back yarn | Fineness | 84 dtex/ 36 f | 84 dtex/36 f | 84 dtex/36 f | 84 dtex/36 f | 84 dtex/36 f | 44 dtex/12 f |
| | | Single yarn fineness | 2.3 dtex | 2.3 dtex | 2.3 dtex | 2.3 dtex | 2.3 dtex | 3.7 dtex |
| | | Yarn type | PET Crimpable yarn | PET 1 H textured yarn | PET Grimpable yarn | PET 2H textured yarn | PET Crimpable yarn | PET Grimpable yarn |
| Knitted structures | Front yarn | | 1-0/3-4 Cord stitch structure | 1-0/3-4 Cord stitch structure | 1-0/3-4 Cord stitch structure | 1-0/3-4 Cord stitch structure | 1-0/4-5 Cord stitch structure | 1-0/3-4 Cord stitch structure |
| | Middle yarn | | 1-0/1-2 Denbigh stitch structure | 1-0/1-2 Denbigh stitch structure | 1-0/1-2 Denbigh stitch structure | 1-0/1-2 Denbigh stitch structure | 1-0/1-2 Denbigh stitch structure | 1-0/1-2 Denbigh stitch structure |
| | Back yarn | | 0-0/3-3 Inlay structure | 0-0/3-3 Inlay structure | 0-0/3-3 Inlay structure | 0-0/3-3 Inlay structure | 0-0/3-3 Inlay structure | 2-3/1-0 Cord stitch structure |
| Knitted fabric | Knitted fabric densities | Course | 44 | 42 | 42 | 40 | 46 | 42 |
| | | Wale | 37 | 37 | 37 | 37 | 38 | 37 |
| | Fineness ratio | | 1.0 | 3.0 | 0.7 | 1.0 | 1.0 | |
| | Napping treatment | | Done | Done | Done | Done | Done | Done |
| | Nap rate (%) | | 80 | 80 | 60 | 80 | 80 | 80 |
| | Number of filaments of nap | | 125030 | 119347 | 67133 | 113664 | 402739 | 358042 |
| | Total deci-tex | | 437606 | 417715 | 205128 | 397824 | 471205 | 418909 |
| Synthetic leather | Cloth thickness (mm) | | 1.35 | 1.35 | 1.15 | 1.24 | 1.52 | 1.45 |
| | Resin thickness (μm) | | 260 | 220 | 130 | 34 | 110 | 200 |
| | Overall thickness (μm) | | 1610 | 1570 | 1280 | 1430 | 1630 | 1650 |
| | 5% circular moduli | Course | 10.30 | 19.29 | 22.29 | 17.98 | 28.32 | 13.32 |
| | | Wale | 15.32 | 20.55 | 19.32 | 17.94 | 13.54 | 11.34 |
| | | Sum | 25.62 | 39.84 | 41.61 | 35.92 | 41.86 | 24.66 |
| | Ease wrinkles | | ++ | ++ | + | ++ | ++ | ++ |

TABLE 2

| | | | Comparative Example 1 | Comparative Example 2 | Comparative Example 3 | Comparative Example 4 | Comparative Example 5 |
|---|---|---|---|---|---|---|---|
| Yarn positions | Front yarn | Fineness | 168 dtex/48 f | 168 dtex/48 f | 168 dtex/48 f | 84 dtex/24 f | 168 dtex/48 f |
| | | Single yarn fineness | 3.5 dtex | 3.5 dtex | 3.5 dtex | 3.5 dtex | 3.5 dtex |
| | | Yarn type | PET 2 H textured yarn | PET 2 H textured yarn | PET 2 H textured yarn | PET Crimpable yarn | PET 2 H textured yarn |
| | Middle yarn | Fineness | 84 dtex/36 f | 84 dtex/24 f | 84 dtex/24 f | 168 dtex/48 f | 84 dtex/24 f |
| | | Single yarn fineness | 2 3 dtex | 3.5 dtex | 3.5 dtex | 3.5 dtex | 3.5 dtex |
| | | Yarn type | PET 1 H textured yarn | PET Grimpable yarn | PET Crimpable yarn | PET Crimpable yarn | PET Crimpable yarn |
| | Back yarn | Fineness | 84 dtex/36 f | 84 dtex/36 f | 84 dtex/36 f | 84 dtex/36 f | 84 dtex/36 f |
| | | Single yarn fineness | 2.3 dtex | 2.3 dtex | 2.3 dtex | 2.3dtex | 2.3 dtex |
| | | Yarn type | PET 1 H textured yarn | PET Crimpable yarn | PET Crimpable yarn | PET Crimpable yarn | PET Grimpable yarn |
| Knitted structures | Front yarn | | 1-0/3-4 Cord stitch structure | 1-0/3-4 Cord stitch structure | 1-0/3-4 Cord stitch structure | 1-0/1-2 Denbigh stitch structure | 1-0/1-2 Denbigh stitch structure |

TABLE 2-continued

| | | | Comparative Example 1 | Comparative Example 2 | Comparative Example 3 | Comparative Example 4 | Comparative Example 5 |
|---|---|---|---|---|---|---|---|
| | Middle yarn | | 1-0/1-2 Denbigh stitch structure | 0-1/1-0 Chain stitch structure | 1-0/1-2 Denbigh stitch structure | 1-0/4-5 Cord stitch structure | 0-1/1-0 Chain stitch structure |
| | Back yarn | | 0-0/3-3 Inlay structure | 0-0/3-3 Inlay structure | 1-2/1-0 Denbigh stitch structure | 0-0/3-3 Inlay structure | 0-0/3-3 Inlay structure |
| Knitted fabric | Knitted fabric densities | Course | 47 | 39 | 40 | 40 | 44 |
| | | Wale | 39 | 36 | 37 | 37 | 39 |
| | Fineness ratio | | 1.0 | 1.0 | 1.0 | 0.3 | 1.0 |
| | Napping treatment | | Not done | Not done | Done | Done | Not done |
| | Nap rate (%) | | 0 | 0 | 50 | 40 | 0 |
| | Number of filaments of nap | | 0 | 0 | 71040 | 56832 | 0 |
| | Total deci-tex | | 0 | 0 | 248640 | 198912 | 0 |
| Synthetic leather | Cloth thickness (mm) | | 0.93 | 1.02 | 1.08 | 1.17 | 0.89 |
| | Resin thickness (μm) | | 220 | 190 | 180 | 130 | 180 |
| | Overall thickness (μm) | | 1150 | 1210 | 1260 | 1300 | 1070 |
| | 5% circular modul | Course | 26.32 | 28.34 | 36.43 | 32.73 | 24.12 |
| | | Wale | 19.32 | 20.30 | 16.12 | 17.21 | 28.43 |
| | | Sum | 45.64 | 48.64 | 52.55 | 49.94 | 52.55 |
| | Ease wrinkles | | – | – | – | – | – |

In all of the synthetic leathers of Examples 1, 2, and 4-6, no ease wrinkles occurred. In the synthetic leather of Example 3, a few ease wrinkles occurred, which were small reduced wrinkles. The number of needle spaces of an underlap in the cord stitch structure knitted with the front yarn was three in the synthetic leathers of Examples 1-4 and 6, and four in the synthetic leather of Example 5. From this result, it is considered that the number of needle spaces of an underlap in the cord stitch structure knitted with the front yarn is preferably three or more in order to inhibit or reduce the occurrence of ease wrinkles. In the synthetic leathers of Examples 1-5, the knitted structure knitted with the back yarn was an inlay structure. In the synthetic leather of Example 6, the knitted structure knitted with the back yarn was a cord stitch structure. From this result, it is considered that the knitted structure knitted with the back yarn is preferably an inlay structure or cord stitch structure in order to inhibit or reduce the occurrence of ease wrinkles.

Meanwhile, in all of the synthetic leathers of Comparative Examples 1-5, ease wrinkles occurred. Ease wrinkles occurred in the synthetic leather of Comparative Example 1 in which the combination of the knitted structures of the tricot knitted fabric was similar to that of Examples 1-4, and a nap was not provided, and in the synthetic leathers of Comparative Examples 3 and 4 in which a nap was provided, and the combination of the knitted structures of the tricot knitted fabric was different from that of Examples 1-4. Accordingly, it is considered that in order to inhibit or reduce the occurrence of ease wrinkles, the cloth needs to have an appropriate thickness which is provided by a combination of knitted structures of the tricot knitted fabric and a nap formed by napping the sinker loop side.

In the synthetic leathers of Examples 1-6, in which the occurrence of ease wrinkles was inhibited or reduced, the sum of the 5% circular modulus as measured in the course direction and the 5% circular modulus as measured in the wale direction was 24.66-41.86 N/25.4 mm. Meanwhile, in the synthetic leathers of Comparative Examples 1-5, in which ease wrinkles occurred, the sum of the 5% circular modulus as measured in the course direction and the 5% circular modulus as measured in the wale direction was 45.64-52.55 N/25.4 mm. Accordingly, it is considered that in order to inhibit or reduce the occurrence of ease wrinkles, the sum of the 5% circular moduli in the course and wale directions of a synthetic leather is preferably in the range of 23-45 N/25.4 mm.

The synthetic leather of the present invention can be used as automotive interior materials and interior decoration materials, and particularly, is suitably applicable to chair seats, steering wheels, shoes, bags, etc., having curved shapes.

The invention claimed is:

1. A synthetic leather comprising:

a cloth; and a resin layer laminated on the cloth, wherein the cloth is a tricot knitted fabric knitted with front yarn, middle yarn, and back yarn, and having a nap, the tricot knitted fabric has a cord stitch structure knitted with the front yarn, a denbigh stitch structure knitted with the middle yarn, and an inlay structure knitted with the back yarn, and the nap is formed by napping a sinker loop side of the tricot knitted fabric.

2. The synthetic leather of claim 1, wherein the cloth has a thickness of 0.9-3.0 mm.

3. The synthetic leather of claim 1, wherein the cord stitch structure knitted with the front yarn has an underlap of not less than three needle spaces.

4. The synthetic leather of claim 1, wherein the inlay structure knitted with the back yarn has an underlap of not less than three needle spaces.

5. The synthetic leather of claim 4, wherein the denbigh stitch structure knitted with the middle yarn has a closed loop.

6. The synthetic leather of claim 1, wherein the nap of the tricot knitted fabric includes 65,000-850,000 filaments per 25.4 mm×25.4 mm, and has 200,000-600,000 total deci-tex per 25.4 mm×25.4 mm.

7. The synthetic leather of claim 1, wherein the front yarn has a fineness of 44-250 dtex.

8. The synthetic leather of claim 1, wherein the middle and back yarns each have a fineness of 30-220 dtex.

9. The synthetic leather of claim 1, wherein
the front yarn has a single yarn fineness of 0.3-5.5 dtex.

10. The synthetic leather of claim 1, wherein
the middle and back yarns each have a single yarn fineness of 0.3-5.5 dtex.

11. The synthetic leather of claim 1, wherein
the sum of a 5% circular modulus in a course direction of the tricot knitted fabric and a 5% circular modulus in a wale direction of the tricot knitted fabric is 23-45 N/25.4 mm.

12. The synthetic leather of claim 11, wherein
the 5% circular modulus in the course direction of the tricot knitted fabric is 9-30 N/25.4 mm, and the 5% circular modulus in the wale direction of the tricot knitted fabric is 10-22 N/25.4 mm.

13. The synthetic leather of claim 1, wherein
the resin layer is laminated on the sinker loop side of the tricot knitted fabric, and
the resin layer has a thickness of 100-280 μm.

* * * * *